US006527826B1

(12) United States Patent
Schwaiger

(10) Patent No.: US 6,527,826 B1
(45) Date of Patent: Mar. 4, 2003

(54) OPERATION METHOD OF FURNACE EQUIPMENT FOR MAGNESIUM ALLOYS

(75) Inventor: Helmut Schwaiger, Kirchdorf/Krems (AT)

(73) Assignee: TCG Unitech Aktiengesellschaft, Kirchdorf /Krems (DE)

( * ) Notice: Subject to any disclaimer, the term of this patent is extended or adjusted under 35 U.S.C. 154(b) by 0 days.

(21) Appl. No.: 09/555,058

(22) PCT Filed: Nov. 12, 1998

(86) PCT No.: PCT/AT98/00279

§ 371 (c)(1),
(2), (4) Date: Nov. 12, 1998

(87) PCT Pub. No.: WO99/27144

PCT Pub. Date: Jun. 3, 1999

(30) Foreign Application Priority Data

Nov. 24, 1997 (AT) ..... 729/97 U

(51) Int. Cl.[7] ..... C22B 9/05; C22B 26/22
(52) U.S. Cl. ..... 75/602
(58) Field of Search ..... 75/602; 266/207; 110/343, 242, 303, 304

(56) References Cited

U.S. PATENT DOCUMENTS 1,898,969 A * 2/1933 Barstow ..... 75/300
5,087,485 A * 2/1992 Cho ..... 427/255.23

FOREIGN PATENT DOCUMENTS

| | | |
|---|---|---|
| DE | 2018407 | 2/1971 |
| DE | 4203193 | 8/1993 |
| WO | 9614439 | 5/1996 |

OTHER PUBLICATIONS

J.F. Heffron et al., "Practical Aspects of Using Sulphur Hexafloride in Fluxless Melting of Magnesium and Its Alloys" in North American Die Casting Assn. Conference: 17th Int. Die Casting Congress . . . , Bd. 94, No. 2, Oct. 18–21, 1993, pp. 322–329.

J. W. Fruehling et al., "Protective Atmospheres for Melting Magnesium Alloys" in *AFS Transactions*, vol. 56, No. 2, Aug. 1969, pp. 159–164.

H. Gjestland et al., "Use of $SF_6$ in the Magnesium Industry: An Environmental Challenge" in *Institute of Materials Conference: Proceedings of the Third International Magnesium Conference*, Apr. 10–12, 1996, pp. 33–41.

Y. P. Aleksandrova et al., "Interaction of Magnesium with Gases" in *Met. Sci. Heat Treat.*, vol. 19, No. 3–4, Mar.–Apr. 1997, pp. 218–221.

* cited by examiner

*Primary Examiner*—Roy King
*Assistant Examiner*—Tima McGuthry-Banks
(74) *Attorney, Agent, or Firm*—Dykema Gossett PLLC

(57) ABSTRACT

A protective furnace gas for protecting a bath of magnesium in furnace equipment includes a mixture of inert gas such as nitrogen and 0.3 to 1.5% by volume of $SO_2$, the mixture being provided in a temperature-controlled room wherein the temperature is at least 22° C. and preferably 25° to 35° C.

5 Claims, 1 Drawing Sheet

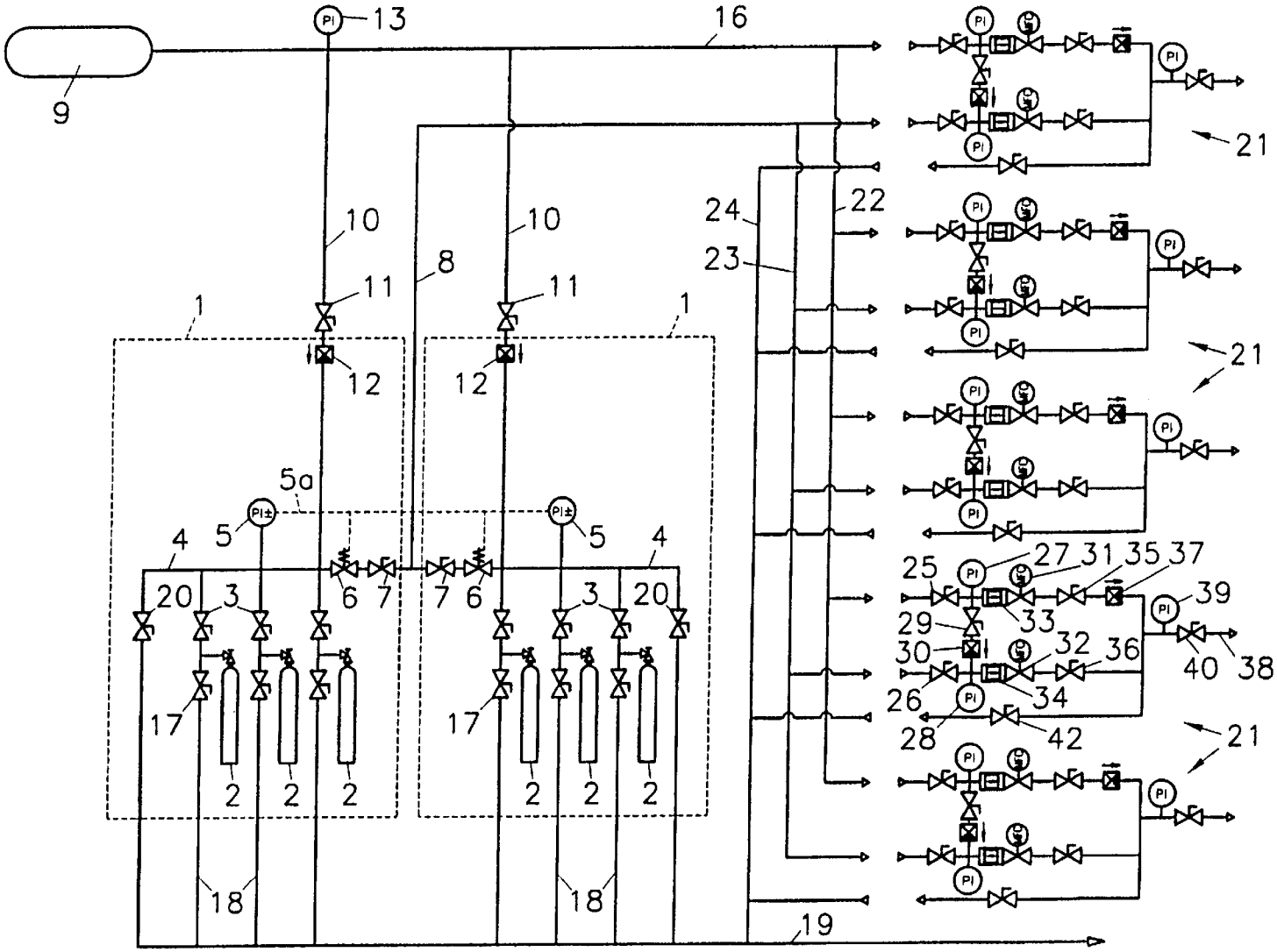
21
21
21
38
39
40
37
35
31
27
36
32
33
34
42
25
29
30
26
28
22
19
24
23
16
1
4
20
2
5
3
18
10
11
12
6
17
7
8
13
5a
9

OPERATION METHOD OF FURNACE EQUIPMENT FOR MAGNESIUM ALLOYS

BACKGROUND OF THE INVENTION

The present invention relates to a method for operating furnace equipment for magnesium alloys in which a bath surface is covered with a protective furnace gas containing a sulfur compound.

THE PRIOR ART

In installations where liquid magnesium is present it is necessary to take special precautions to reliably prevent the access of atmospheric oxygen because magnesium is extremely combustible in the liquid state. $SF_6$ is used as such a protective furnace gas, for example, which reacts with the magnesium of the melt and forms a protective layer which protects the melt from the access of atmospheric oxygen. Occasionally, mixtures of $SF_6$ and nitrogen are used for this purpose. Since $SF_6$ concerns a greenhouse gas, its use is problematic for reasons of environmental protection. Moreover, the costs for this gas are relatively high.

It has already been considered as an alternative to use $SO_2$ as a protective furnace gas. $SO_2$ is available at relatively low cost and, like $SF_6$, forms a protective layer on a magnesium melt. The application of $SO_2$ has been prevented up until now because it concerns an extremely unpleasant smelling gas which in medium to high concentrations is detrimental to health and promotes corrosion. During the use of $SO_2$ in the conventional manner it is not possible to prevent the escape of gas from the furnaces or the like which leads to an impermissible burden on the ambient environment. In particular, maximum workplace concentrations will be exceeded by far.

It is further known to use gas mixtures of $SO_2$ and dried air as a protective furnace gas for magnesium furnaces. It has not yet been managed, on the one hand, to control the toxic and corrosive effect of $SO_2$ and, on the other hand, to realise a secure operation of the furnace.

It is the object of the present invention to provide a method which, on the one hand, allows a secure treatment of magnesium melts and, on the other hand, causes the lowest possible burden on the environment.

SUMMARY OF THE INVENTION

This object is achieved in accordance with the invention in such a way that a mixture of $SO_2$ and an inert gas is used as a protective furnace gas, with the volume share of $SO_2$ being set precisely to a value which is in a range of between 0.3% and 1.5%, preferably between 0.5% and 1.0%. It was surprisingly noticed that in the case of $SO_2$, there is a small range in which there is a sufficient protective effect on the one hand and a burden on the environment can be substantially prevented on the other hand. The relevant aspect of the present invention is the setting of a precise value of the $SO_2$ concentration in the protective furnace gas. Since very low $SO_2$ concentrations are used, precise process control and the avoidance of fluctuations in the gas composition is very important to prevent fires.

Nitrogen is used particularly preferably as the inert gas. Nitrogen is available at low cost and is not critical to the environment. In a particularly preferable embodiment of the method in accordance with the invention, it is provided that the mixture of $SO_2$ and the inert gas is performed in an air-conditioned room whose temperature is kept above 22° C., and preferably in a range of between 25° C. and 35° C. It has been noticed that a satisfactory mixture of $SO_2$ and nitrogen is only possible from a certain minimum temperature at a performance pressure >2 bars. Moreover, temperature-induced fluctuations in volume and pressure of the involved gases can be securely prevented by the mixture in an air-conditioned room. A temperature of approx. 30° C. is particularly preferable.

Moreover, the present invention relates to an apparatus for producing a protective furnace gas for furnace equipment for magnesium alloys with a storage tank for a sulfur compound, a storage tank for an inert gas and a mixing device. The apparatus in accordance with the invention is characterized in that the mixing device is arranged to provide a precise flow rate control of $SO_2$ and nitrogen and is arranged in an air-conditioned room. Safety gas cells are provided in an air-conditioned room which receive the $SO_2$ cylinders. Nitrogen is taken from a conventional tank. The mixture of $SO_2$ and nitrogen is performed through electronic mass flow meters which are arranged in the air-conditioned room. The gas mixture thus produced is conveyed to the respective furnace equipment via pipelines and adjusted to consumption by way of local control systems. The furnace equipment can concern smelting furnaces, holding furnaces, dosing furnaces and pig casting belts for magnesium alloys.

$SO_2$ sensors are provided in the safety gas cells which already respond to low $SO_2$ concentrations. Once an $SO_2$ cylinder has been emptied, the same is scavenged with nitrogen together with the pipelines in order to exclude any health hazards during the exchange of the cylinders. In this manner it can be prevented reliably that any $SO_2$ escapes into the environment.

As a result of the low $SO_2$ concentration of the protective furnace gas, any pollution of the environment and any annoyance caused by bad smell, particularly in the furnace area, can be securely prevented. Secure operations can be ensured by the precisely set mixture ratio.

BRIEF DESCRIPTION OF THE FIGURE

The FIGURE shows a schematic diagram of an apparatus in accordance with the invention.

DETAILED DESCRIPTION OF THE PREFERRED EMBODIMENT

Components are described with the broken lines 1 which are arranged in two safety cabinets. Gas cylinders 2 are used as storage vessels for sulphur dioxide which is supplied to a collecting line 4 by way of stop valves 3. A control line **5*a* is supplied via a manometer 5*a* which triggers a solenoid valve 6. A supply line 8 for $SO_2$ is connected via a further stop valve 7**.

A storage vessel 9 for nitrogen is connected with the distributor line 4 in each of the two safety cabinets 1 via a line 10, a stop valve 11 and a return valve 12 in order to provide nitrogen for scavenging the lines during the exchange of the cylinders 2. A manometer 13 shows the nitrogen pressure in a nitrogen main line 16. The individual cylinders 2 are in connection with a waste gas collecting line 19 via stop valves 17 and waste gas lines 18. The distributor line 4 is vented into the waste gas collecting line 19 via separate stop valves 20. The circuit as described above allows scavenging the respective line sections with nitrogen prior to the exchange of one of the cylinders 2, so that any escape of $SO_2$ can be reliably prevented.

The right-hand section of the FIGURE shows the mixing device for supplying the individual consumers. Since the individual mixers 21 are principally designed in the same way, only one of them is designated with a reference numeral and is described in the description.

The individual mixers 21 are supplied via a first distributor panel 22 with nitrogen and via a second distributor panel 23 with sulphur dioxide. A third distributor panel 24 is used for connecting the mixer 21 with the waste gas collecting line 19. Stop valves 25 and 26 are provided in the individual mixers 21, which valves are connected with the distributor panel 22 or 23. Manometers 27 and 28 indicate the respective nitrogen or sulphur dioxide pressure after the stop valves 25 and 26. A stop valve 29 for scavenging is provided between the nitrogen line and the sulphur dioxide line, with a return valve 30 being provided downstream of the same. Highly precise flow rate meters 31 for nitrogen and 32 for sulphur dioxide are used for setting the precise quantity ratio for the two gases. Filters 33 and 34 are provided upstream of the flow rate meters 31 and 32. The gases are joined in a supply line 38 via further stop valves 35 and 36 and a return valve 37, which supply line is provided with a manometer 39 and a stop valve 40. A scavenging line 41 with a stop valve 42 is used for preventing any pollution of the environment during maintenance work and the like.

The entire arrangement as exhibited in the FIGURE is arranged in accordance with the invention in an air-conditioned room which is kept at a temperature of approx. 30° C. In this manner the mixture ratio of the gases can be kept at a precisely predetermined value, and a favourable thorough mixture can be ensured.

Flow governors (not shown) can be provided in the individual consumers, which governors only influence the supplied quantity of the gas mixture, but not the composition of the gas.

The present invention thus not only allows savings in costs, but also a substantial reduction of the burden placed on the environment and a particularly safe operation in dealing with magnesium melts.

What is claimed is:

1. A method of protecting magnesium in a bath of magnesium in furnace equipment from contact by ambient air which comprises the steps of:

(a) providing a temperature-controlled room, (b) supplying $SO_2$ gas to said temperature-controlled room, (c) supplying an inert gas to said temperature-controlled room, (d) mixing-said $SO_2$ gas and said inert gas in said temperature-controlled room to provide a protective furnace gas containing 0.3 to 1.5% by volume of $SO_2$ gas, and (e) conveying said protective furnace gas to said furnace equipment containing said bath of magnesium.

2. The method of claim 1, wherein the protective furnace gas provided in step (b) contains 0.5 to 1.0% by volume of $SO_2$ gas.

3. The method of claim 1, wherein said inert gas in step (c) is nitrogen.

4. The method of claim 1, including a step of controlling the temperature-controlled room to a temperature of above 22° C.

5. The method of claim 4, wherein said temperature is controlled to between 25° and 35° C.

* * * * *